United States Patent [19]

Alexander

[11] 4,258,911

[45] Mar. 31, 1981

[54] SKATEBOARD ARENA

[76] Inventor: Alexander J. Alexander, 22052 Arcos, Mission Viejo, Calif. 92691

[21] Appl. No.: 99,591

[22] Filed: Dec. 3, 1979

[51] Int. Cl.[3] ..... A63J 3/00

[52] U.S. Cl. ..... 272/3; 273/411; 340/323 R

[58] Field of Search ..... 272/3, 4, 5, 56.5 SS, 272/56.5 R, 26, 32, 71, 70; 4/487, 488, 494, 513; D25/2; 340/323 R; 273/411

[56] References Cited

U.S. PATENT DOCUMENTS

| | | | |
|---|---|---|---|
| 318,026 | 5/1885 | Pusey | 272/56.5 SS UX |
| 1,357,995 | 11/1920 | Kitterman | 272/32 |
| 1,886,220 | 11/1932 | Payne | 272/3 |
| 3,913,332 | 10/1975 | Forsman | 272/26 X |
| 4,009,883 | 3/1977 | Yellowlees et al. | 340/323 R X |
| 4,121,821 | 10/1978 | Graham | 272/3 |

*Primary Examiner*—Richard C. Pinkham
*Assistant Examiner*—Arnold W. Kramer
*Attorney, Agent, or Firm*—John T. Matlago

[57] ABSTRACT

An arena specially designed for use by skateboarders comprises an oval shaped bowl having relatively steeply curved sidewalls and a long gradually inclined ramp leading to each longitudinal end thereof. An oval shaped mound having an elevation on the order of one-half that of the top of the ramps at the longitudinal ends of the bowl is integrally formed on the floor in the center of the bowl. The curved sidewall portions opposite the central mound extend upwardly and inwardly to an elevation which is higher than the longitudinal ends of the bowl. Also located at each longitudinal end of the bowl is a truncated cone shaped ball pit which is mounted on the front wall of an elevated portion of a building structure such that it overhangs the inclined surface on the upper end of the ramp.

10 Claims, 6 Drawing Figures

4
4
3
3
90
91
91
66
66
66
66
67
67
67
67
70
70
53
59
62
62
60
52
52
55
64
40
44
0
5
10
15
20
25
30

SKATEBOARD ARENA

BACKGROUND AND SUMMARY OF THE INVENTION

This invention relates to sports arenas and more particularly to an arena specially designed for use by skateboarders.

The increasing interest in skateboards by teenagers and young adults in the past several years is being shown by the great number of such enthusiasts using public areas such as streets, sidewalks and parks for their enjoyment. It is thus seen that there is a need to provide an arena that has been specially designed for use by such enthusiasts.

Furthermore, it is believed that providing an arena especially adapted for use by competitive teams of skateboarders would be highly desirable in that it enables the younger generation to gain a new "identity" by challenging the sport in a supervised and organized environment rather than by joining street gangs and creating hazardous conditions by skateboarding in public areas.

Accordingly, one of the objects of the present invention is to provide a sports arena specially designed for use by skateboarders and the like.

Another object of the present invention is to provide a sports arena specially adapted for use by competitive teams of skateboarders.

Still another object of the present invention is to provide a skateboard arena that has been specially designed to aid a skateboarder while maneuvering about on the lower level of the floor of the arena to gain sufficient velocity to enable him to ride up ramps into scoring areas provided on either end of the arena.

Briefly, the sports arena of the present invention comprises an oval shaped bowl having relatively steep upwardly curved sidewalls and an elongated gradually inclined ramp leading up to each longitudinal end thereof. An oval shaped mound having an elevation which is less than that of the top of the ramps on the longitudinal ends of the bowl is integrally formed on the center of the floor of the bowl. The curved sidewall portions opposite the central mound extend upwardly and inwardly to an elevation which is higher than the longitudinal ends of the bowl. Also located at each longitudinal end of the bowl is a truncated cone shaped ball pit which is mounted on the front wall of an elevated portion of a building structure such that it overhangs the inclined surface on the upper end of the ramp.

Other objects and advantages of the present invention will become more fully apparent from consideration of the following detailed description of the accompanying drawings which illustrate a preferred embodiment of the invention.

DRAWING SUMMARY

Figure 6:
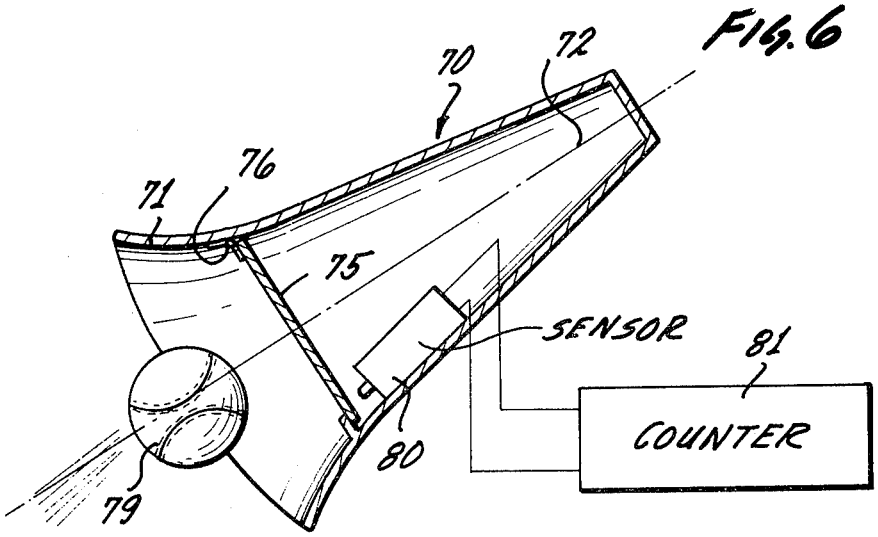
Figure 4:
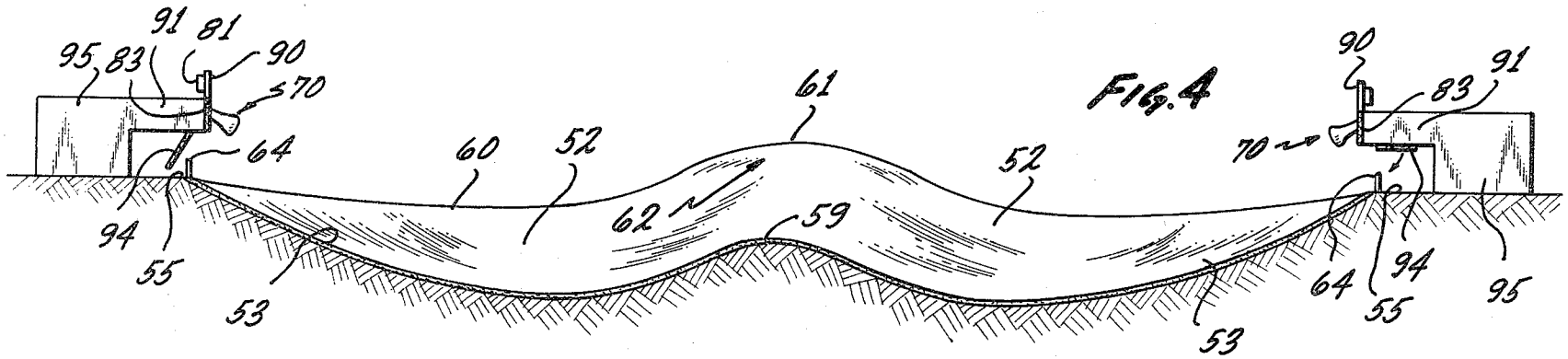
FIG. 4 is a longitudinal sectional view as taken on line 4—4 of FIG. 2.
Figure 4A:
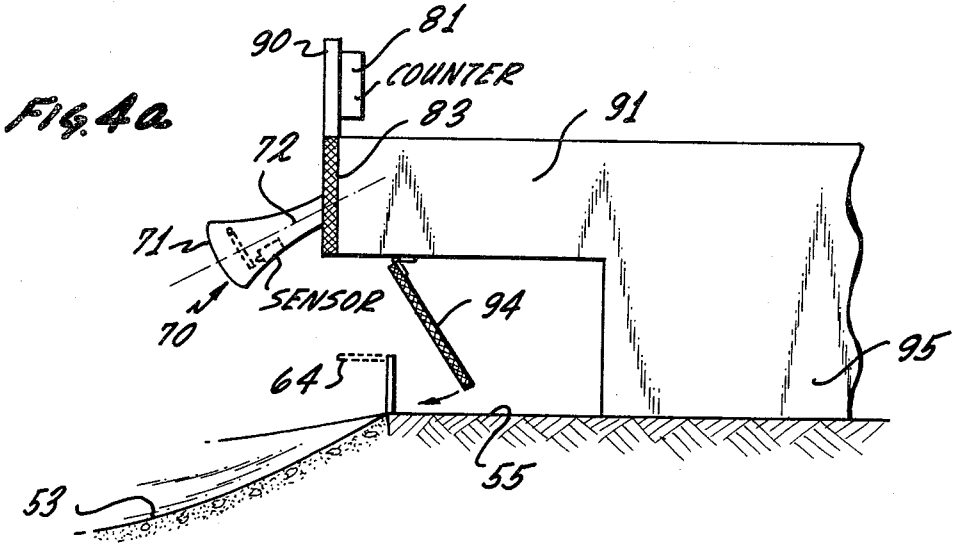
Figure 5:
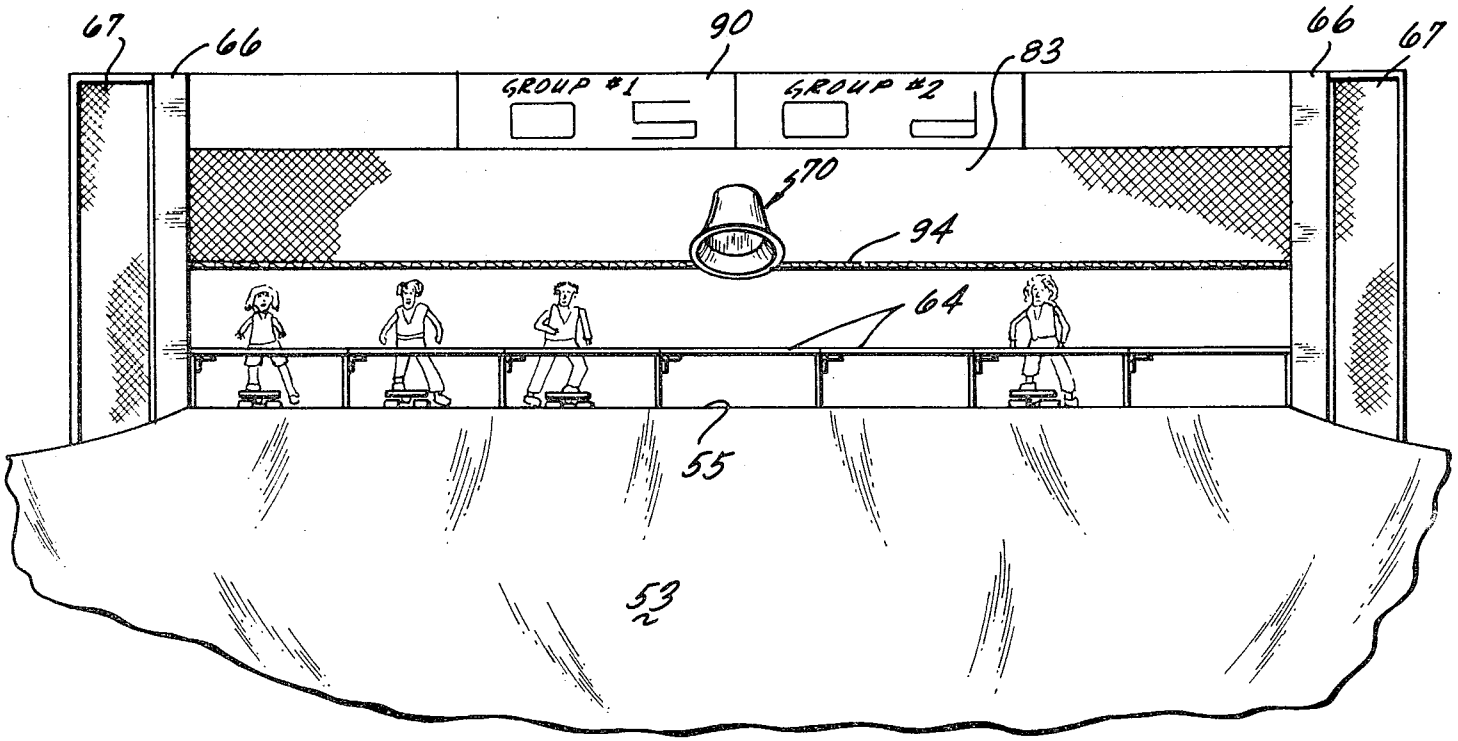

FIG. 4*a* is an enlarged side view of the ball pit scoring area and other structure at each end of the arena;

FIG. 5 is an enlarged front view of the ball pit scoring area at each end of the arena; and FIG. 6 is an enlarged side sectional view of the ball pit provided at each longitudinal end of the arena.

PREFERRED EMBODIMENT

Figure 2:
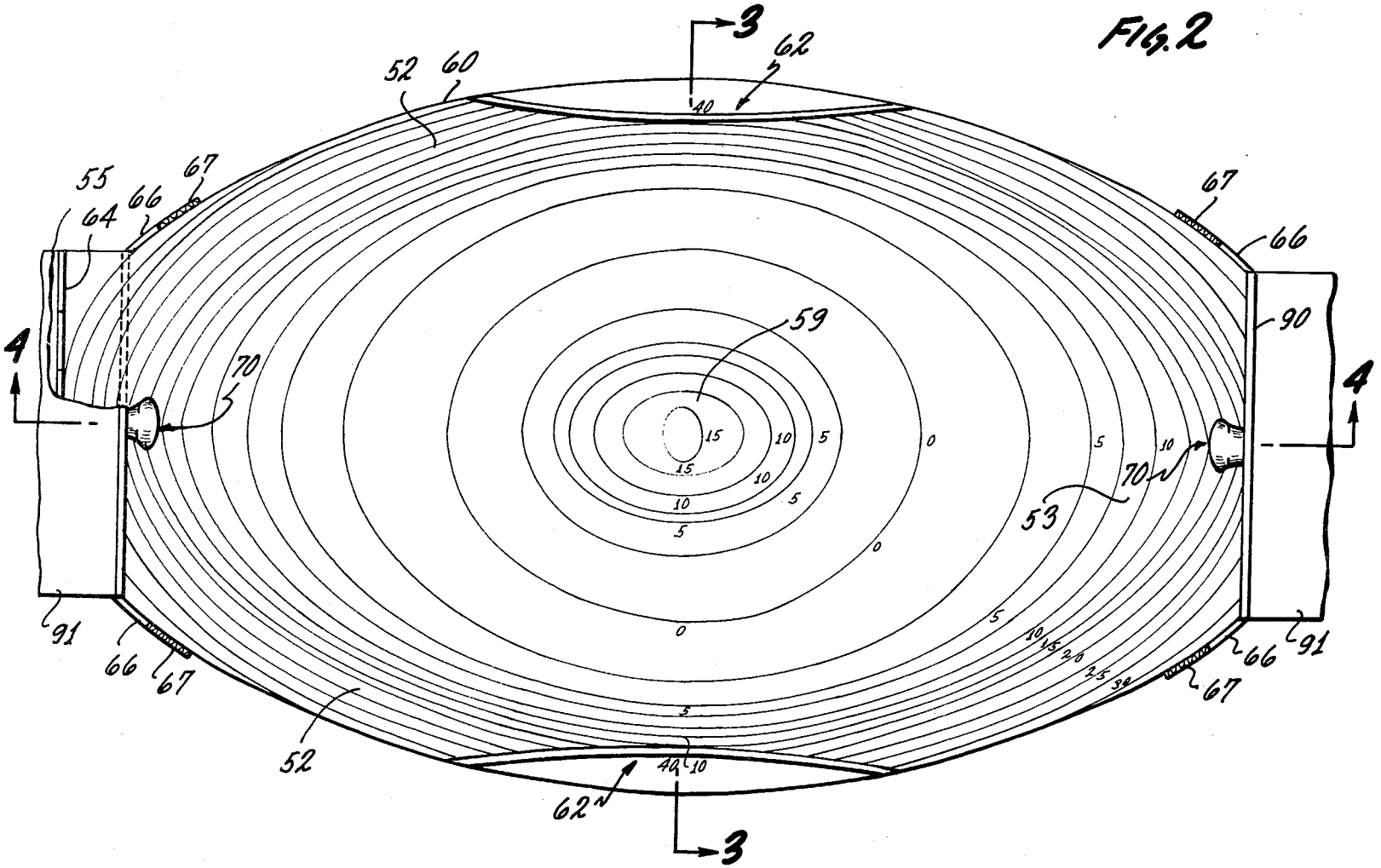
FIG. 2 is a plan view of the skateboard arena of FIG. 1.

Referring to the drawings, the skateboard arena 50 embodying the features of the present invention because of its large size is preferably formed in an excavation in the earth. Thus, the plan view of the bowl 51 of the arena, which is oval shaped, may typically be on the order of 300 feet in length and 150 feet in width. The bowl 51 is formed with upwardly curved relatively steep sidewalls 52 and with gradually inclined ramps 53 leading up to transverse platforms 55 provided on each longitudinal end thereof. An oval shaped hump or mound 59 forming an integral part of the bowl 51 is centered on the floor thereof. As illustrated in FIG. 2 by contour lines, indicating each 2½ feet change in elevation, the central mound 59 is approximately 15 feet high and its curved surface gradually merges with the lowest level on the floor of the bowl 51, as indicated by contour line 0. The transverse platforms 55 at the longitudinal ends of the arena are located approximately at a 30 foot elevation above the floor of the bowl.

Figure 1:
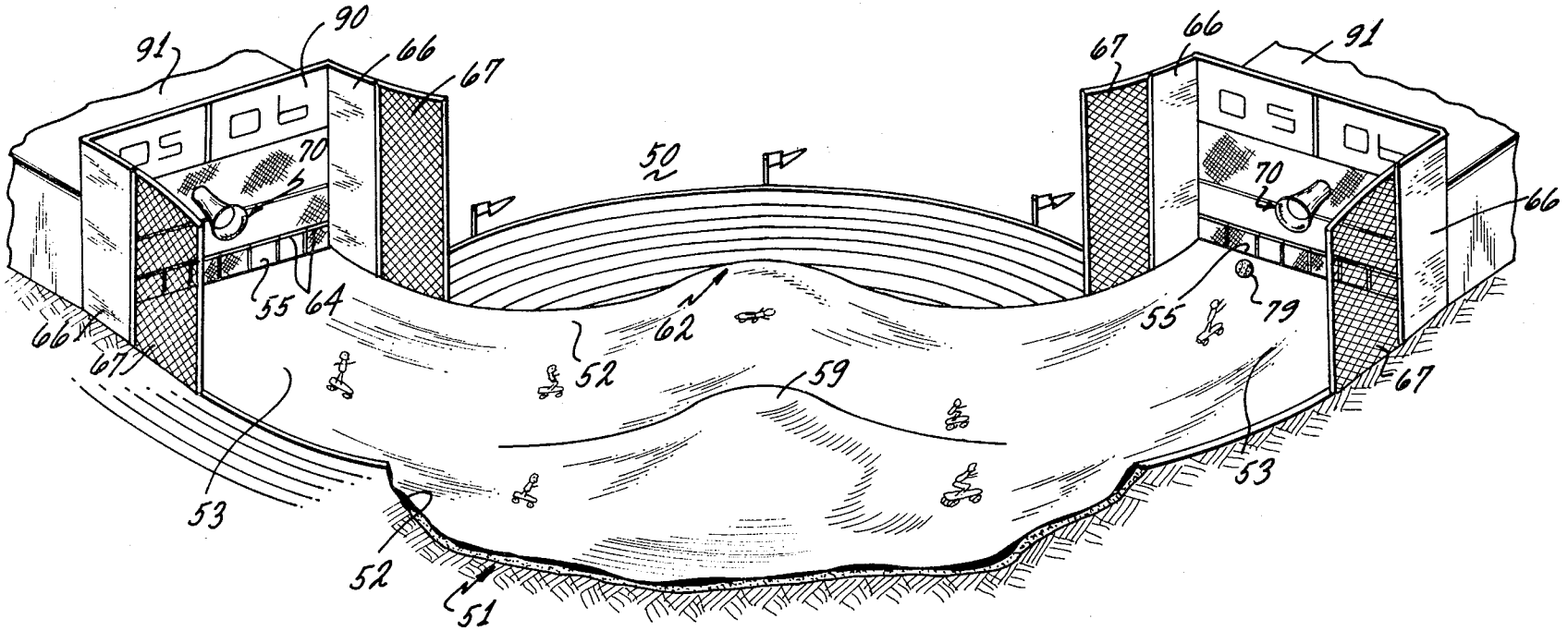
FIG. 1 is an overall perspective view of the skateboard arena of the present invention.
Figure 3:
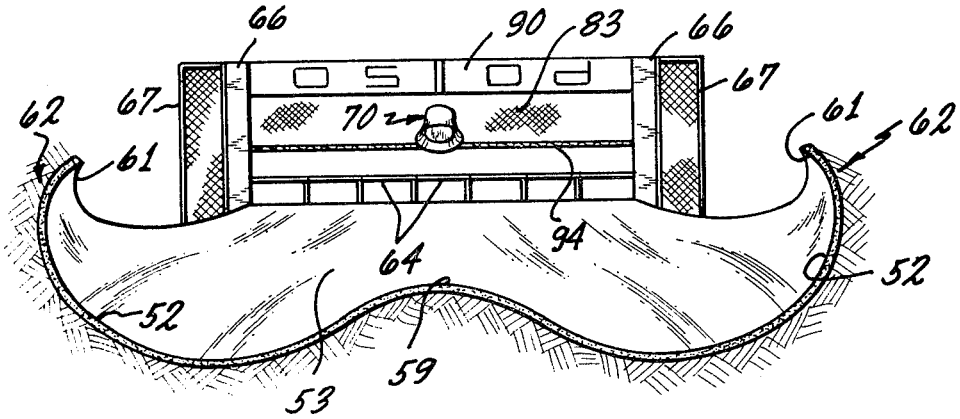
FIG. 3 is a transverse sectional view as taken on line 3—3 of FIG. 2.

As best illustrated in FIG. 4, which is a longitudinal sectional view as taken on line 4—4 of FIG. 2, the elevation of the top of the sidewall 52 on each side of the bowl 51 gradually lowers from the longitudinal end thereof to a level of approximately 27 feet and then rises more steeply opposite the central mound 59 to form elevated sidewalls portions 62 having a level of approximately 40 feet. It should be noted that the upper edges 60 of the sidewall portions 52 on either end of the elevated central sidewall portions 62 curve outwardly while the upper edges 61 of the elevated central sidewall portions 62 themselves curve inwardly (FIGS. 1 and 3).

The material from which the bowl 51 is constructed is preferably reenforced concrete, but it may be desired in some locations to construct it of other materials such as plates of steel or fiberglass with adequate support framing. An emulsion coating preferably covers the interior surface of the bowl to thereby provide a safer ride.

It should now be clear from FIG. 3, which is a transverse sectional view as taken along line 3—3 of FIG. 2, that the cross section portion between each side of the central mound and the opposing sidewall 52 and including the elevated sidewall portion 62 tends to resemble a substantial portion of a tunnel-like structure commonly referred to as a "half pipe". As will be discussed hereinafter, these "half pipe" configurations provide the skateboarder with a means for maneuvering while on the central floor area of the bowl 51 to elevate his position so that he can attain sufficient potential energy which can be converted to the velocity needed to enable him to easily ride up the end ramps 53 into the scoring pit areas.

Referring to FIG. 5, located on each of the transverse platforms 55 provided on the ends of the bowl 51 is a row of a plurality of starting gates 64 for the members of the respective teams of skateboarders. Each starting gate 64 may be in the form of a cross bar which automatically swings horizontally to an open position during the course of the game (FIG. 4*a*). Provided on the side ends of the bowl 51, starting at each side of the transverse platform 55, is a high vertical concrete wall 66 and a chain link fence 67 which latter continues on in the direction of the side edge of the bowl 51 for several feet to thereby guard the side ends of the bowl referred to as the scoring pit area.

A building structure at each longitudinal end of the bowl 51 includes an elevated observing room 91 located above the platform 55 and a locker room 95 located behind the platform 55. The windowed front wall of the elevated observing room which overhangs the upper end of the ramp 53 is covered by a protective screen 83 to protect judges, announcers, radio and television personnel, etc. who may be sitting in the area. In addition, a lower screen 94 which is hinged at its upper end beneath the observing room 91 is provided behind the starting gates 64. At the start of a game when the skateboarders are standing on the transverse platforms 55 behind each of the starting gates 64, the lower screens 94 are automatically held in their upwardly swung position. It should be noted that the vertical concrete walls 66 provided on the side ends of the bowl 51 contact the sides of the building structure. Thus, the walls 66 together with the lower screen 94 when swung down enclose the scoring pit area at each end of the bowl.

A ball pit 70 in the form of a truncated cone with an outwardly flared mouth 71 is mounted on the screened upper front wall of the observing room 91. The ball pit 70 is so mounted at a level of approximately 8 feet above the center starting gate 64 and is disposed with its longitudinal axis angled downwardly so that it is substantially parallel with the sloping surface of the ramp therebelow.

Positioned within the throat of the flared mound 71 (FIG. 6) of ball pit 70 is a stopper plate 75 which is hinged at its upper end 76. When the stopper plate 75 is hit by a ball 79 thrown into the ball pit 70 by a skateboarder, the swinging of the stopper plate 75 activates a sensor 80 located in the lower rear of the ball pit 70 which indicates a score on an electronic counter 81. As shown in FIG. 3, a scoreboard 90 which is situated above the row of starting gates 64 at each end of the bowl 50 displays the total score of each of the two teams in the game.

It should now be clear that when a skateboarder is on the lowest level of the floor of the arena his prime objective is to obtain a ride on his skateboard with sufficient momentum to carry him up either of the ramps 53 on the ends of the arena into one or the other of the scoring pit areas where the scoring activity is taking place.

According to the proposed rules of the game, when a player is on the floor of the arena he must be moving at all times with at least one foot on his skateboard. Thus, if a skateboarder finds during the course of play that he is stalled on the floor of the arena he uses his one foot to push or elevate himself on his skateboard up to the top of the central mound 59 or up the curved sidewalls 52 so that by virtue of his position he can ride down therefrom to gain momentum.

It should now be appreciated that for a skateboarder to move up the mound 59 or curved sidewalls 52 by pushing his skateboard with his foot is a slow process and there is a limit as to how high he can in this manner move up the steep or upper portions of the sidewalls 52.

However, by skillfully swinging himself back and forth in the "half pipe", i.e., between a sidewall 52 and the central mound 59, and pushing himself with his one foot at the end of each swing, for example, a skateboarder is able to acquire a high level position on the elevated sidewall portion 62. Thus, by virtue of his position, all the energy of the skateboarder is in the form of potential energy which becomes transformed into kinetic energy as he rides down the curved sidewalls 62, thus enabling him to experience a continued ride along the floor of the bowl and up the ramp 53 into the scoring pit area on one end of the arena.

Another use of the curved sidewalls 52 and especially the curved elevated sidewall portions 62 is to enable a skateboarder to acquire a few seconds of delay during the course of play by the deceleration he experiences as he rides upwardly thereon. Thus, while one of the skateboarders on a team is attempting to retrieve the ball 79 being thrown at the ball pit 70 on the opponents end of the arena, a skateboarder may momentarily abide his position in the central portion of the arena by riding straight up the steep curved sidewalls 52. Since the skateboarder retains his energy in this manner for a few seconds by virtue of his position, by proper use of the delay timing, he is able to make a fast ride toward his end ramp 53 in the arena while carrying the ball which in the meantime has been thrown to him.

It should be clear that the elevated sidewall portions 62 in the central area of the bowl are made the highest elevation points on the bowl. Thus, if the skateboarder should reach that point in his maneuvers he can be assured of gaining sufficient momentum or velocity, on riding down therefrom, to carry him all the way up an end ramp 53 into the area below the ball pit 70 without the need for again pushing his skateboard with his foot.

At the start of the game between competing teams when the crossbars forming the center starting gate 64 automatically open as indicated by dotted lines in FIG. 4*a*, the leading skateboarders at each end of the arena push off from their respective starting positions on transverse platforms 55 to ride down the respective end ramps 53. This initial momentum carries the lead skateboarders along the floor of the bowl and up the central mound 59 where one of them obtains possession of the ball 79 positioned at the top thereof to start the game.

According to the proposed rules of the game, as soon as one of the lead skateboarders obtains possession of the ball, the other starting gates 64 on both ends of the arena automatically open to permit all the other skateboarders to push off from their respective starting positions on the transverse platform 55. After all the players have left their starting positions or platform 55, screen 94 automatically swings down to close off the area behind the starting gates 64 which leads to locker room 95, and thereby contains a miss thrown ball within the playing area.

The lead skateboarder carrying the ball 79 in his hands then proceeds toward his scoring pit area on the opposite end of the arena. However, since he normally does not have enough momentum, because of his ride up the central mound 59, to carry him all the way up the end ramp 53 into his scoring pit area, he throws the ball 79 to one of his teammates who by his maneuvers has either retained or otherwise acquired the necessary momentum to carry him into the scoring pit area.

The teammate may possess such a momentum either by riding down the ramp from one end of the arena along a selected course over the curved sidewalls 52 of the bowl whereby he retains most of his momentum or by having built his momentum by working his way, as previously described, up into an elevated position on the elevated curved sidewall portions 62.

When the ball 79 is successfully thrown by a skateboarder into the ball pit 70, causing the counter 81 to indicate a score count, the ball 79 will immediately fall out of the pit 70 so that it can be retrieved by one of the skateboarders of either team and the play continues.

It should be especially noted, as best illustrated in FIGS. 4 and 4*a*, that the scoring pit area below the ball pit 70 is not level but rather formed by the inclined surface on the upper portion of the ramp 53. Inasmuch as the longitudinal axis 72 of the ball pit 70 is angled downwardly so as to be substantially parallel to the slope of the ramp 53, the flared mouth 71 of the ball pit 70 is located approximately 10 feet above the downwardly sloping surface of the ramp 53 directly therebelow.

Thus the sloping surface of the scoring area below the ball pit 70 provides an unusually challenging structure for the skateboarders in which they must skillfully maneuver in their attempts to score by throwing the ball 79 into the ball pit 70 and to retreive the ball when it rebounds back therefrom as play continues.

It should be apparent that the arena 50 of the present invention, because of its unusual shape, when not in use for competitive games, is ideally suited for use by skateboarders and rollerskaters to enable them to display their individual acrobatic talents. Moreover the arena is suited for the presentation of ballet shows by both skateboarders and rollerskaters. Furthermore, the size and shape of the arena is ideally adapted to provide a running track for use by joggers in a safe environment during the off hours of the use for competitive sports.

While in order to comply with the statute the invention has been described in language more or less specific as to structural features, it is to be understood that the invention is not limited to the specific features shown but that the means and construction herein disclosed comprise a preferred form of putting the invention into effect, and the invention is therefore claimed in any of its forms or modifications within the legitimate and valid scope of the appended claims.

What is claimed is:

1. A skateboard arena comprising:

an oval shaped bowl having relatively steep upwardly curved sidewalls and an elongated gradually inclined ramp formed on each longitudinal end thereof;

an oval shaped mound integrally formed on the center of the floor of the bowl; and an elevated inwardly curved sidewall portion on each of the curved sidewalls of said bowl opposite said mound.

2. A skateboard arena as designed in claim 1 wherein a ball pit in the form of a truncated cone is located at either longitudinal end of said bowl.

3. A skateboard arena as defined in claim 1 wherein a plurality of starting gates for skateboarders are provided at each longitudinal end of said bowl.

4. A skateboard arena as defined in claim 1 wherein the elevation of said mound is less than the elevation of the longitudinal ends of said bowl.

5. A skateboard arena as defined in claim 1 wherein said elevated inwardly curved sidewall portions on each of the curved sidewalls of said bowl opposite said mound is higher in elevation than the longitudinal ends of said bowl.

6. A skateboard arena as defined in claim 1 wherein said oval shaped arena has a length on the order of 300 feet and a width on the order of 150 feet, said center mound is on the order of 15 feet in elevation, said longitudinal ends are on the order of 30 feet in elevation, and said elevated inwardly curved sidewall portions are on the order of 40 feet in elevation.

7. A skateboard arena as defined in claim 2 wherein:

said ball pit in the form of a truncated cone is disposed with its longitudinal axis angled downwardly so that it is substantially parallel with the sloping surface of the ramp therebelow; and sensing means in said ball pit for providing a signal when a ball is thrown therein.

8. A sports arena comprising:

an oval shaped bowl having relatively steep upwardly curved sidewalls and having an elongated gradually inclined ramp formed on each longitudinal end thereof;

an oval shaped mound integrally formed on the center of the floor of the bowl and having an elevation which is less than the elevation of the longitudinal ends of said bowl;

the curved sidewall portions opposite said center mound being higher in elevation than the longitudinal ends of said bowl and having inwardly curved upper edge portions;

a plurality of starting gates for game players disposed at each longitudinal end of said bowl;

a building structure at each longitudinal end of said bowl;

said building structure including an overhanging front portion located above said starting gates; and a truncated cone shaped ball pit mounted on the overhanging front portion of said building structure at each longitudinal end of said bowl;

said ball pit disposed with its longitudinal axis substantially parallel with the sloping surface of the ramp therebelow.

9. A skateboard arena as defined in claim 8 including a protective screen on a window area provided on the front portion of said building structure; and a movable screen hinged to the bottom of said front portion of said building structure to close off the area behind said starting gates.

10. A skateboard arena as defined in claim 8 including upright walls on the side ends of the said arena abutting the sides of said building structure.

* * * * *